US007314697B2

(12) United States Patent
Mc Stravick et al.

(10) Patent No.: US 7,314,697 B2
(45) Date of Patent: Jan. 1, 2008

(54) TONER COMPOSITIONS INCLUDING LARGE EXTERNAL LATEX PARTICLES

(75) Inventors: Mary L. Mc Stravick, Fairport, NY (US); Sue E. Blaszak, Penfield, NY (US); Paul C. Julien, Webster, NY (US); Susan J. Kremer, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 409 days.

(21) Appl. No.: 10/902,068

(22) Filed: Jul. 30, 2004

(65) Prior Publication Data

US 2005/0031979 A1 Feb. 10, 2005

Related U.S. Application Data

(63) Continuation-in-part of application No. 10/248,383, filed on Jan. 15, 2003, now abandoned.

(51) Int. Cl.
*G03G 9/08* (2006.01)

(52) U.S. Cl. ..... 430/108.4; 430/108.1; 430/137.18; 430/137.21

(58) Field of Classification Search ..... 430/108.11, 430/108.4, 108.6, 108.7, 108.1, 137.18, 137.21
See application file for complete search history.

(56) References Cited

U.S. PATENT DOCUMENTS

| | | | |
|---|---|---|---|
| 5,683,845 | A | 11/1997 | Sata et al. |
| 5,716,752 | A | 2/1998 | Ott et al. |
| 5,763,132 | A | 6/1998 | Ott et al. |
| 6,187,489 | B1 | 2/2001 | Oishi et al. |
| 6,316,155 | B1 | 11/2001 | Kudo et al. |
| 6,566,025 | B1 | 5/2003 | Mc Stravick et al. |

FOREIGN PATENT DOCUMENTS

| | | | |
|---|---|---|---|
| EP | 197 242 | A2 | 10/1986 |
| EP | 558 046 | A1 | 9/1993 |
| EP | 0 784 237 | A | 7/1997 |
| EP | 0 898 205 | A | 2/1999 |
| JP | 62-059666 | A | 3/1987 |
| JP | 01-057268 | | 3/1989 |
| JP | 02-183269 | | 7/1990 |

OTHER PUBLICATIONS

Gotoh, Keishi et al. Powder Technology Handbook, 2nd ed. New York: Marcel-Dekker, Inc. (1997) pp. 7 & 9.*

* cited by examiner

*Primary Examiner*—Christopher RoDee
(74) *Attorney, Agent, or Firm*—Oliff & Berridge, PLC

(57) ABSTRACT

A toner composition includes toner particles having at least one spacer of substantially monodisperse latex particles that are dried and attached to the toner particles, in which the attached latex particles have an average particle size of from about 60 nm to about 500 nm. The presence of the spacer enables improved toner transfer efficiency maintainability while maintaining excellent tribo level, tribo stability with aging, charge through performance and cohesion behavior with aging.

15 Claims, 3 Drawing Sheets

FIG. 1
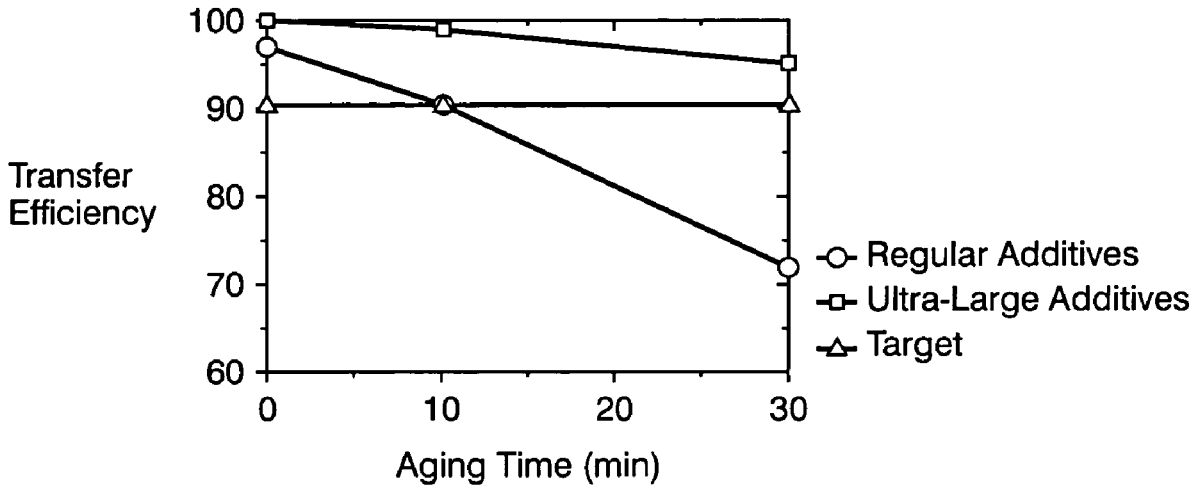
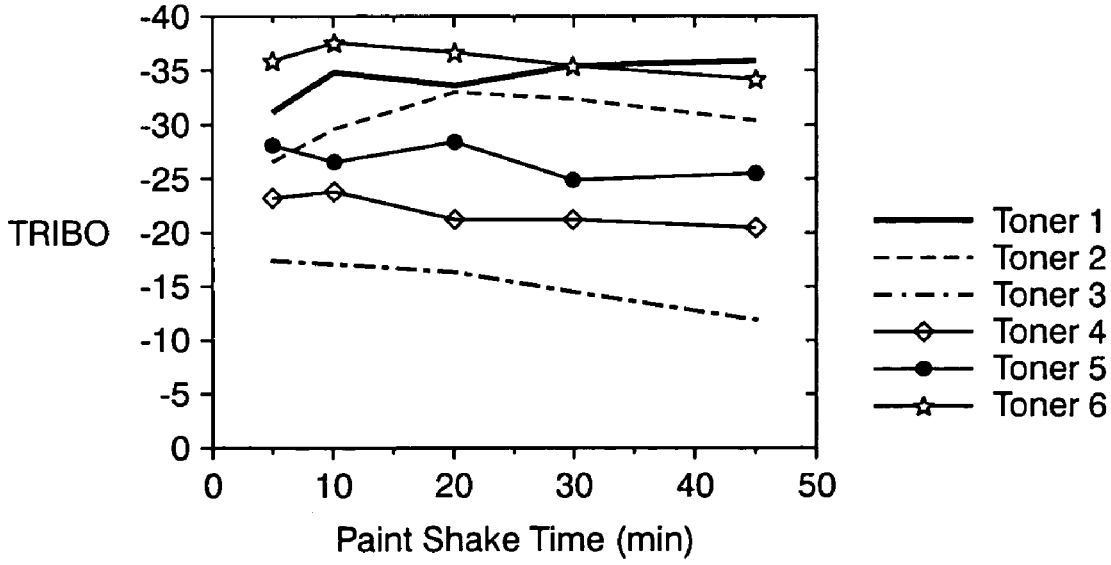
FIG. 2

FIG. 3
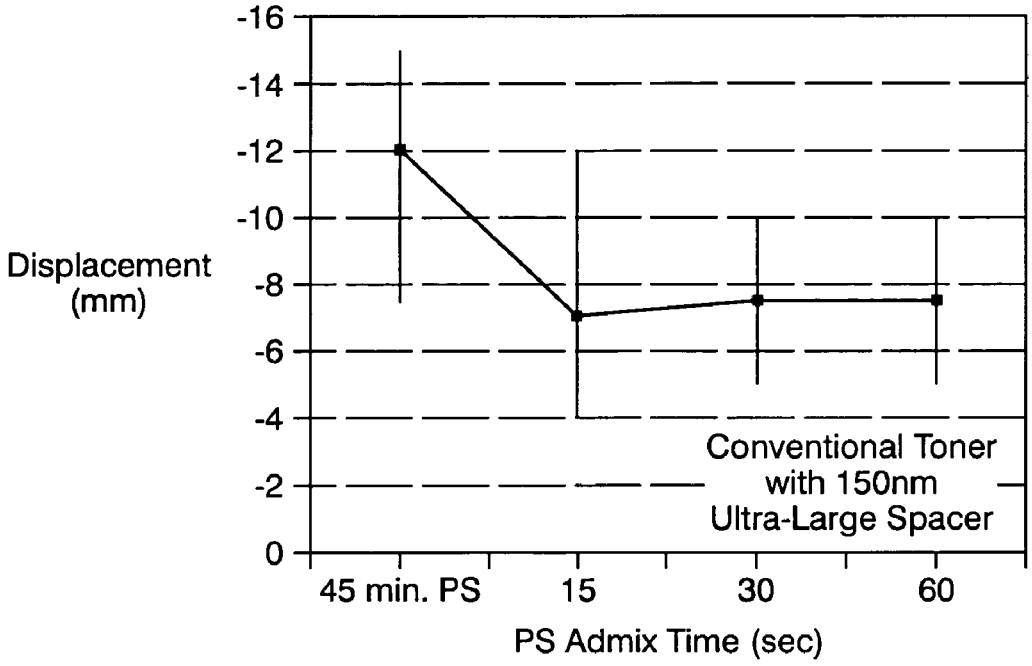
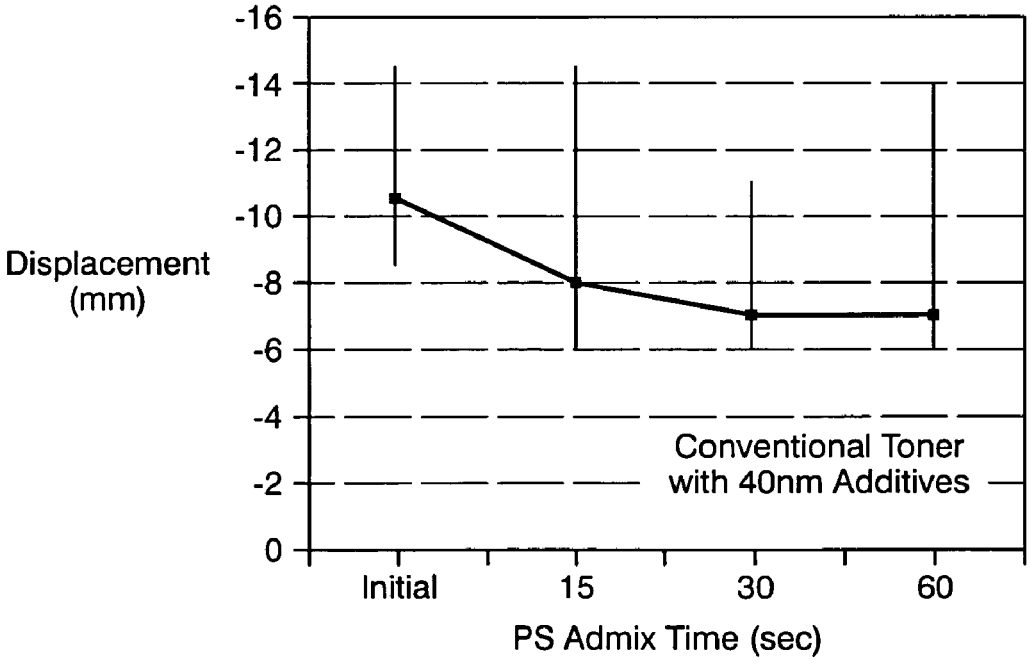
FIG. 4

TONER COMPOSITIONS INCLUDING LARGE EXTERNAL LATEX PARTICLES

CROSS-REFERENCE TO RELATED APPLICATION

This application is a continuation-in-part of application Ser. No. 10/248,383, filed Jan. 15, 2003 now abandoned. Application Ser. No. 10/248,383 is incorporated by reference herein in its entirety.

BACKGROUND OF THE INVENTION

1. Field of Invention

The invention relates to color toner and developer compositions, and more specifically, to color toner and developer compositions that include very large or ultra large external additives, in particular latex particles, among other conventionally sized external additives, on external surfaces of the toner particles.

2. Description of Related Art

U.S. Pat. No. 5,763,132, incorporated herein by reference in its entirety, describes a process for decreasing toner adhesion and decreasing toner cohesion, which comprises adding a hard spacer component of a polymer of polymethyl methacrylate (PMMA), a metal, a metal oxide, a metal carbide, or a metal nitride, to the surface of a toner comprised of resin, wax, compatibilizer, and colorant excluding black, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner. See the Abstract and column 1, lines 9-28.

U.S. Pat. No. 5,716,752, incorporated herein by reference in its entirety, describes a process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner. See the Abstract.

Neither of these references teaches the possible use of latex particles as spacers. In fact, both references require that the spacers described therein be attached to the toner particles with high power injection in a fluid bed milling device during the size reduction (grinding) step, thereby requiring the use of hard spacer particles. Softer latex particles thus could not be used in such attachment method as they would be crushed or buried into the toner particles, and thus rendered ineffective for their intended purpose. Further, neither reference teaches a method of attaching the spacers to the toner particles after completion of grinding by, for example, blending.

Alternative ultra large external additives that act as spacers on toners are still desired, as are spacers that might be applied in methods less intensive than the application methods described in each of U.S. Pat. Nos. 5,763,132 and 5,716,752.

SUMMARY OF THE INVENTION

In embodiments of the present invention, the invention is directed to a toner composition comprising toner particles having at least one spacer comprised of latex particles attached to the toner particles, wherein the latex particles have an average particle size of from about 60 nm to about 500 nm, preferably from about 100 nm to about 300 nm or from about 220 nm to about 500 nm, more preferably from about 300 nm to about 500 nm.

In further embodiments, the invention is directed to a process for decreasing toner cohesion comprising forming toner particles with grinding, and following completion of the grinding step, attaching to the toner particles at least one spacer selected from the group consisting of latex particles and polymer particles, wherein the latex particles or polymer particles have an average particle size as mentioned above.

Thus, the latex particle and polymer particle spacers of the invention are applied to the toner particles in a non-intensive manner. Application of such spacer particles enables the toner and developer including such toner to exhibit reduced toner cohesion, improved flow and transfer efficiency stability and hence excellent development and transfer stability during copying/printing in xerographic imaging processes, and minimized development falloff, for example including maintaining DMA (developed mass per area on a photoreceptor), TMA (transferred mass per area from a photoreceptor), and/or triboelectric charging characteristics for an extended number of imaging cycles.

BRIEF DESCRIPTION OF THE DRAWINGS

Illustrated in the FIGS. 1-5 are graphs showing, for example, some advantages achievable with the toner composition and processes of the present invention.

DETAILED DESCRIPTION OF PREFERRED EMBODIMENTS

Figure 5:
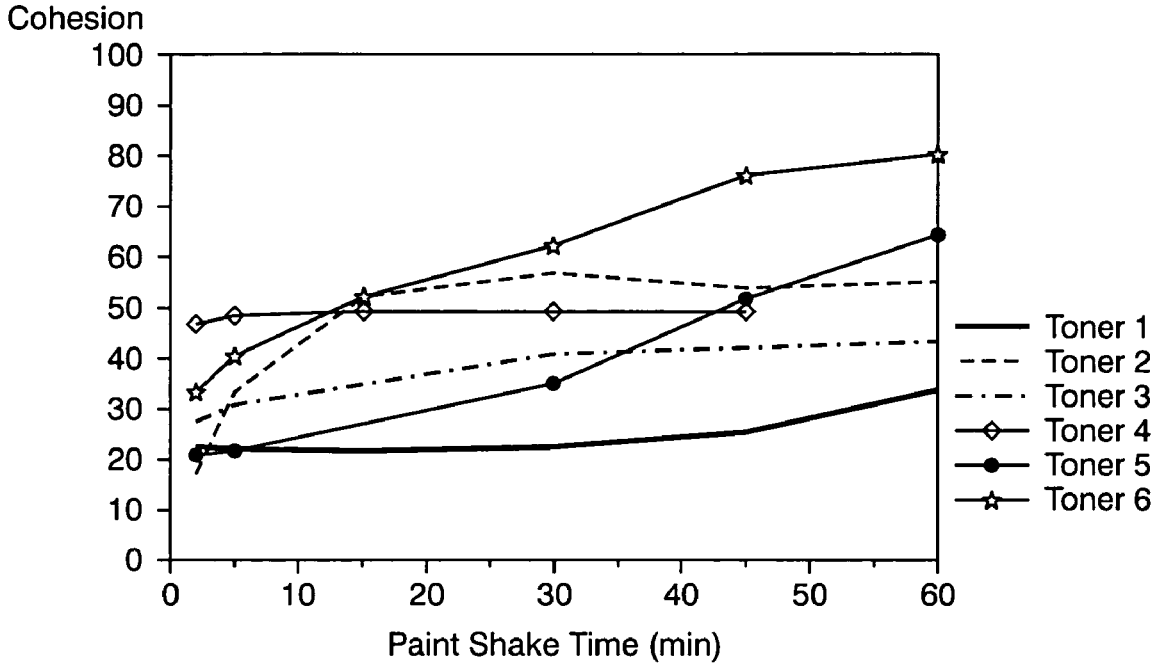

In a first aspect of the present invention, the invention relates to a toner composition comprised of toner particles having at least one spacer comprised of latex particles attached to the toner particles, wherein the latex particles have an average particle size of from about 60 nm to about 500 nm, preferably from about 100 nm to about 300 nm or from about 220 nm to about 500 nm, more preferably from about 300 nm to about 500 nm.

In further embodiments of the invention, the spacers may also include non-latex polymer particles. These polymer particle spacers also have an average particle size of from about 60 nm to about 500 nm, with a preferred size range of from about 100 to about 300 nm or from about 220 nm to about 500 nm, more preferably from about 300 nm to about 500 nm.

These ultra large latex particle spacers may be added to the toner composition in various effective amounts such as, for example, about 20 percent by weight or less, preferably about 0.1 to about 20 percent by weight, more preferably about 1 to about 10 percent by weight, most preferably about 1 to about 5 percent by weight, of the toner composition.

The latex particle or polymer particle spacers on the surfaces of the toner particles of the toner composition are believed to function to reduce toner cohesion, stabilize the toner transfer efficiency and reduce/minimize development falloff characteristics associated with toner aging such as, for example, triboelectric charging characteristics and charge through. These external additive particles have the aforementioned ultra large particle size and are present on the surface of the toner particles, thereby functioning as spacers between the toner particles and carrier particles and hence reducing the impaction of smaller conventional toner external surface additives having a size of from, for example, about 8 to about 40 nm, such as silica, titania and/or zinc stearate, during aging in the development housing. The spacers thus stabilize developers against disadvantageous burial of conventional smaller sized toner external additives by the development housing during the imaging process in the development system. The ultra large external additives, such as latex and polymer particles, function as a spacer-type barrier, and therefore the smaller conventional toner external additives of, for example, silica, titania and zinc stearate are shielded from contact forces that have a tendency to embed them in the surface of the toner particles. The ultra large external additive particles thus provide a barrier and reduce the burial of smaller sized toner external surface additives, thereby rendering a developer with improved flow stability and hence excellent development and transfer stability during copying/printing in xerographic imaging processes. The toner compositions of the present invention exhibit an improved ability to maintain their DMA (developed mass per area on a photoreceptor), their TMA (transferred mass per area from a photoreceptor) and acceptable triboelectric charging characteristics and admix performance for an extended number of imaging cycles.

Toner cohesion refers to toner particles adhering to each other. This disadvantage is avoided or minimized with the toners of the present invention.

The toner and developer compositions of the present invention can be selected for electrophotographic, especially xerographic, imaging and printing processes, including digital processes. The toners may be used with particular advantage in image development systems employing hybrid scavengeless development (HSD) in which an aggressive developer housing is employed that has a tendency to beat conventional smaller sized external surface additives into the surface of the toner particles, thereby causing the toner properties to degrade upon aging. Of course, the toner may be used in an image development system employing any type of development scheme without limitation, including, for example, conductive magnetic brush development (CMB), which uses a conductive carrier, insulative magnetic brush development (IMB), which uses an insulated carrier, semiconductive magnetic brush development (SCMB), which uses a semiconductive carrier, etc.

In a preferred embodiment, the spacer particles having the aforementioned sizes are comprised of latex particles. Any suitable latex particles may be used without limitation. As examples, the latex particles may include rubber, acrylic, styrene acrylic, fluoride, or polyester latexes, or mixtures thereof. These latexes may be copolymers or crosslinked polymers. Specific examples include acrylic, styrene acrylic and fluoride latexes from Nippon Paint (e.g. FS-101, FS-102, FS-104, FS-201, FS-401, FS-451, FS-501, FS-701, MG-151 and MG-152) with particle diameters in the range from 45 to 550 nm, glass transition temperatures in the range from 65° C. to 102° C. and triboelectric charges ranging from −130 μcoul/gram to +330 μcoul/gram.

These latex particles may be derived by any conventional method in the art. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. The use of latex particles having a very narrow particle size distribution as formed, and in particular a substantially monodisperse particle size distribution as formed, e.g., by polymerization, is most preferred. By "substantially monodisperse particle size distribution" is meant that the extent of particles in the as-formed latex having a size substantially different from the average particle size is very small such that the particle size distribution is substantially monodisperse about the average particle size distribution. More specifically, the as-formed latex particles having a substantially monodisperse particle size distribution in the present application refers to latex particles in aqueous suspension having a GSD of 1.0 to 1.1 for latex primary particle sizes in the range of 100 nm to 500 nm as measured in a Miocrotrac UPA150 particle size analysis system. The latex particles are dried and the resultant particles are dry blended onto the toner. Any agglomerates that result from the drying process are broken down and distributed on the toner surface during blending.

Following formation of the latex particles, for example by polymerization, the latex particles are dried, which may cause some degree of agglomeration among the latex particles. The dried latex particles are then subsequently dry blended with the toner particles in order to form large external additives on the toner particles. The dry blending may result in some of the latex particles, particularly any previously agglomerated particles, being reduced as a result of the blending.

Latex particles that have a non-monodisperse particle size distribution may be classified in an effort to achieve substantially monodisperse latex particles having the required size and size distribution to act as effective spacers as discussed above.

In a further aspect of the invention, in particular the aspect of the invention relating to the method of application of the spacer particles to the toner particles, the spacer particles may also comprise polymer particles. Any type of polymer may be used to form the spacer particles of this embodiment. For example, the polymer may be polymethyl methacrylate (PMMA), e.g., 150 nm MP1451 or 300 nm MP116 from Soken Chemical Engineering Co., Ltd. with molecular weights between 500 and 1500K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

Preferably, the polymer particles forming the spacer particles of this aspect of the invention are of a type that is not suitable for attachment to the toner particles with high power injection in a fluid bed milling device during the size reduction (grinding) step. That is, the polymer particles are of a softer (e.g., lower melting point and/or less crosslinked) material that would be destroyed if attempted to be attached via high power injection in a fluid bed milling device. In addition, the polymer particles may be chosen to impart a specific tribo charge to the toner particle based on the surface energy of the polymer particle.

The toner particles of the invention comprise at least a toner binder resin and a colorant.

Illustrative examples of suitable toner resins, especially thermoplastic resins, selected for the toner compositions of the present invention include polyamides, polyolefins, styrene acrylates, styrene methacrylates, styrene butadienes, polyesters, especially reactive extruded polyesters, crosslinked styrene polymers, epoxies, polyurethanes, vinyl resins, including homopolymers or copolymers of two or more vinyl monomers, and polymeric esterification products of a dicarboxylic acid and a diol comprising a diphenol. Vinyl monomers may include, for example, styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including, for example, methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; and styrene/butadiene copolymers with a styrene content of from about 70 to about 95 weight percent. In addition, crosslinked resins, including polymers, copolymers, homopolymers of the aforementioned styrene polymers may be selected.

As the toner resin, mention may also be made of esterification products of a dicarboxylic acid and a diol comprising a diphenol. Such resins are illustrated in, for example, U.S. Pat. No. 3,590,000, the disclosure of which is totally incorporated herein by reference. Other specific toner resins include styrene/methacrylate copolymers, and styrene/butadiene copolymers; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, and extruded polyesters, especially those with a gel (cross-linked resin) amount (see, for example, U.S. Pat. No. 6,358,657, incorporated herein by reference in its entirety).

Also, waxes with a molecular weight of from about 1,000 to about 10,000, such as polyethylene, polypropylene, and paraffin waxes, may be included in, or on, the toner compositions as fuser roll release agents. Other conventional toner additives may be included in the toner particles without limitation, for example, charge enhancing additives, etc.

The resin may comprise, for example, from about 50 to about 98 weight percent of the toner particles.

The colorant may be any suitable colorant including, for example, a dye, pigment, etc. The colorant is preferably present in an amount of from, for example, about 1 to about 20 weight percent of the toner particle. The colorant may impart any suitable color to the toner particle, including, for example, black, red, blue, yellow, green, brown, orange, cyan, magenta, mixtures thereof, etc.

Numerous well known suitable colorants, such as pigments, dyes, or mixtures thereof, and the like can be selected as the colorant for the toner particles. Such colorants are conventional and well-known in the art, and thus are not detailed herein.

In addition, the toner particles of the invention also preferably include one or more external additive particles. Any suitable surface additives may be used in the present invention. Most preferred in the present invention are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for, e.g., toner flow, tribo enhancement, admix control, improved development and transfer stability and higher toner blocking temperature. $TiO_2$ is applied for, e.g., improved relative humidity (RH) stability, tribo control and improved development and transfer stability.

The external surface additives preferably have a primary particle size of from about 5 nm to about 40 nm, preferably about 8 nm to about 40 nm as measured by, for instance, scanning electron microscopy (SEM) or calculated (assuming spherical particles) from a measurement of the gas absorption, or BET, surface area.

The most preferred $SiO_2$ and $TiO_2$ external additives have been surface treated with compounds including DTMS (decyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP silica, obtained from Wacker Chemie, coated with an amino functionalized organopolysiloxane; TS530 from Cabot Corporation, Cab-O-Sil Division, a treated fumed silica; SMT5103 titania, obtained from Tayca Corporation, comprised of a crystalline titanium dioxide core MT500B, coated with DTMS.; MT3103 titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive for the toners of the invention, the zinc stearate providing lubricating properties. Zinc stearate provides, for example, developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. A commercially available zinc stearate known as ZINC STEARATE L, obtained from Ferro Corporation, which has an average particle diameter of about 9 microns as measured in a Coulter counter, may be suitably used.

Each of the external additives present may be present in an amount of from, for example, about 0.1 to about 8 percent by weight of the toner composition. Preferably, the toners contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, about 0.1 to 6 weight percent silica and about 0.1 to 3 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the charging characteristics of the developer compositions described herein, and as optional components there can be incorporated into the toner or on its surface negative charge enhancing additives inclusive of aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

While any desired toner particle size may be used, in a preferred embodiment of the invention, the finished toner particles have an average particle size (volume median diameter) of from about 5.0 to about 9.0 microns, most preferably of from about 6.0 to about 8.0 microns, as measured by the well known Layson cell technique. The toner preferably also exhibits a narrow particle size distribution, e.g., a geometric standard deviation (GSD) of approximately 1.30 or less, preferably less than 1.25 by number for conventional toner and less than 1.25 by number and volume for chemical toner.

Also, there can be included in the toner compositions of the present invention low molecular weight waxes, such as polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K.K., and similar materials. The commercially available polyethylenes have a molecular weight of from about 1,000 to about 1,500, while the commercially available polypropylenes that may be utilized for the toner compositions of the present invention are believed to have a molecular weight of from about 4,000 to about 7,000.

The low molecular weight wax materials may be present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

The toner particles of the invention may be made by any suitable process in the art. For example, the toner compositions of the present invention can be prepared by a number of methods such as melt mixing and heating resin binder particles, colorant, etc. in a toner extrusion device, for example a ZSK40 available from Werner Pfleiderer, and removing the formed toner composition from the device.

Subsequent to cooling, the toner composition may be subjected to grinding for the purpose of achieving toner particles with a volume median diameter of less than about 25 microns, and preferably from about 5 to about 15 microns, which diameters are determined by, for example, a Layson cell. External additives other than the ultra large spacer particles may be added to the toner before, during or subsequent to grinding. The external additives, and in particular at least the latex particles, are preferably added in a dry blending procedure with the toner particles.

Subsequently, the toner compositions can be classified utilizing, for example, a Donaldson Model B classifier for the purpose of removing fines, that is, toner particles less than about 4 microns volume median diameter. There is also removed free/loosely attached spacer (ultra large particles) as fines. The external additives other than the spacer particles are preferably incorporated onto the toner particles subsequent to both grinding and classification. This is most preferably accomplished in, for example, a Henschel blender. After blending, toners may be turbo screened at 45 microns to remove any loose additive agglomerates and toner grits formed during additive blending.

Subsequent to at least the grinding step in the formation of the toner particles, the spacer particles of the invention are incorporated onto the surface of the toner particles. As above, this is preferably done in a dry blending step in which the spacer particles are dry blended together with the previously ground toner particles. A Henschel blender may preferably be used for the blending. The additional external additives discussed above may be added into the blender so as to be incorporated onto the toner particles at the same time as the spacer particles.

The blending may be conducted in one or more steps. As but one example, in a first blending step, the smaller sized external additives (i.e., other than the spacer particles) may be blended, and then subsequently, the spacer particles may be blended in a second blending step. Heat may be applied during the blending step(s), but should be kept below the melting point of the components of the toner so as not to destroy the toner particles during incorporation of the external additives and spacer particles.

Once the toner particles are formed, developer compositions may then be formed employing the toner particles. For the formulation of developer compositions, carrier components are mixed with the toner particles, particularly carrier components that are capable of triboelectrically assuming an opposite polarity to that of the toner composition. For example, the carrier particles may be selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in, for example, U.S. Pat. No. 3,847,604. The selected carrier particles can be used with or without a coating of any desired and/or suitable type. The carrier particles may also include in the coating, which coating can be present in one embodiment in an amount of from about 0.1 to about 5 weight percent, conductive substances such as carbon black in an amount of from about 5 to about 30 percent by weight and/or insulative substances such as melamine in an amount from about 5 to about 15 percent by weight. Polymer coatings not in close proximity in the triboelectric series may be selected as the coating, including, for example, KYNAR® and polymethylmethacrylate mixtures. Coating weights can vary as indicated herein; generally, however, from about 0.3 to about 2, and preferably from about 0.5 to about 1.5 weight percent coating weight is selected.

The diameter of the carrier particles, preferably spherical in shape, is generally from about 35 microns to about 500, and preferably from about 35 to about 75 microns, thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

Evidence that the use of latex particles and polymer particles as a spacer provides the above-mentioned advantages is further illustrated with reference to FIGS. 1 to 5.

FIG. 1 illustrates the transfer efficiency of toners after zero through-put aging in an A Color 635 housing. In the A color development housing, developer mass on the development sleeve (MOS) is maintained between 350 and 400 grams/$m^2$ while developed mass per unit area on the photoreceptor (DMA) is maintained at 0.45 mg/$cm^2$. The transfer efficiency of a toner of the invention including ultra large spacer particles (150 nm sol-gel silica, X24, from Shin-Etsu Chemical Co., Ltd.) is compared against the same toner that includes only conventional smaller sized external additives. In this example, the base toner is a styrene acrylate chemical toner with a 5.5 micron diameter. The smaller sized external additives are typically RY50, a 40 nm fumed silica from Degussa AG and MT3103, a 15 nm×40 nm titania from Tayca. Similar transfer efficiency falloff is also seen with toners with STT100H and TAF500T01 titanias as external additives. STT100H is a 40 nm titania from Titan Kogyo while TAF500T01 is a 50 nm titania from Fuji Titanium Industry, Co., Ltd. The stable target transfer efficiency is also included for comparison. As can be seen in FIG. 1, including the ultra large spacer particles of the present invention dramatically improves the transfer efficiency stability.

Transfer efficiency is defined as (DMA-RMA)/DMA where DMA is the developed mass per unit area on the photoreceptor and RMA is the residual mass per unit area remaining on the photoreceptor after transfer is complete. Both DMA and RMA are measured by a vacuum suck-off technique where toners are vacuumed off the photoreceptor into a pre-weighed particle filter.

This experience of improved transfer efficiency stability with chemical toner would seem to indicate that the ultra-large spacers would also be beneficial for transfer efficiency maintainability for conventional toners.

FIG. 2 illustrates the stability of toner tribo as a function of toner aging with and without ultra-large spacers. The desire is to have stable tribo in a tribo range optimized for the particular development system chosen. Paint shaking toner in a closed environment with steel beads is a surrogate to non-throughput aging of toner in a machine. The desire is to have stable tribo behavior as a function of time. FIG. 2 compares the tribo behavior of 6 toners.

Toner 1 is a conventional toner with typical 40 nm external additives. Tribo stability with time is excellent. Toner 2 is a conventional toner with a fluorine treated 150 nm sol-gel silica completely replacing the 40 nm silica. There is no detrimental effect of replacing the 40 nm silica with the ultra large spacer for tribo stability. Toner 3 is a conventional toner with a non-fluorine treated 150 nm sol-gel silica replacing the 40 nm silica. Tribo stability is compromised as well as tribo level. Toner 4 is a conventional toner with 150 nm PMMA replacing the 40 nm silica. In this case, tribo stability is excellent but tribo level is compromised. Toner 5 is a conventional toner with a 40 nm silica, a 150 nm non-fluorine treated sol-gel silica and a 40 nm titania. Tribo stability is good but tribo level is still low. Toner 6 is a conventional toner with a 40 nm silica, 150 nm PMMA and a 40 nm titania. In this case, tribo stability and tribo level are both excellent. The amounts of additives, types of additives and treatments on additives all play a critical role in determining tribo stability and level. By carefully optimizing additive type and amount, it is possible to achieve the transfer efficiency benefit of the ultra large spacer while maintaining excellent tribo levels and tribo stability with aging.

The control toner in FIG. 2 is a toner comprising a binder and at least one colorant, wherein the binder comprises a polypropoxylated bisphenol A fumarate resin having linear portions and crosslinked portions of high density crosslinked microgel particles, wherein the at least one colorant comprises at least about 3% by weight of the toner, and wherein the toner further comprises external surface additives of silicon dioxide powder, titanium dioxide powder and zinc stearate.

Tribo is measured in a standard tribo blow-off cage where a screen of the appropriate size holds the carrier in the cage and the toner is blown out of the cage. The change in charge of the cage is monitored through an electrometer and the change in mass of the cage is measured with a balance. Tribo is calculated from delta charge/delta mass.

Another toner property is charge-through behavior. Specifically, after toner has been aged in a developer housing, additives become impacted in the toner surface and the toner charging behavior may change. When fresh toner is added to the housing to increase toner concentration, ideally that toner charges relative to the carrier. If fresh toner is significantly different in surface chemistry from aged toner, the fresh toner may charge relative to the aged toner and force the aged toner to go opposite polarity in sign. This phenomenon is referred to as charge-through and causes high background on prints. FIGS. 3 and 4 illustrate that charge-through is not negatively impacted by the presence of an ultra-large spacer. Specifically, FIG. 3 shows that the toner of the present invention exhibits satisfactory charging behavior as new toner is added to aged toner as compared to the control toner of FIG. 4 with smaller sized external additives. FIG. 3 is based on a conventional toner with 40 nm titania and 150 nm sol-gel silica and FIG. 4 is based on a conventional toner with 40 nm titania and 40 nm fumed silica.

In FIGS. 3 and 4, displacement in mm is directly proportional to toner charge. The first data point at 45 min PS (45 minutes non-throughput paint shake) is a measure of the aged toner charge. The data point indicates the center of the charge distribution while the length of the bar indicates the spread of the charge distribution. The next data point at 15 sec admix indicates the toner charge and distribution of charge 15 sec after fresh toner has been added and mixed with the aged toner. The following data points are for 30 seconds and 60 seconds of mixing. The goal is to maintain average charge and charge spread well away from zero or opposite polarity. FIGS. 3 and 4 illustrate that both the conventional toner with a 150 nm sol-gel silica ultra large spacer and 40 nm titania and the conventional toner with 40 nm titania and 40 nm fumed silica both have acceptable charge-through behavior.

Finally, FIG. 5 illustrates the cohesion aging behavior for the toners of the invention that include therein the ultra large spacer particles described herein. The toners are the same as those evaluated in FIG. 2 above. The goal in cohesion aging is to have the time track of cohesion as flat as possible (lower numbers are desirable). Toners are paint shake aged with steel balls and the cohesion is measured as a function of time. Toner is placed into a stack of screens of three sizes (53 microns, 45 microns, 38 microns). The screens are vibrated at a fixed amplitude for a fixed amount of time. The toner travels through the 53 micron screen, to the 45, to the 38 and through. As toner cohesion increases, more toner is left in each screen. At the end of the vibration period, the weight of toner in each screen is measured and added. For zero toner left in any screen, the weight is zero and the cohesion is zero indicating perfect flow. For higher amounts of toner in each screen, the cohesion number increases to a maximum of 100, indicating no flow. For optimum toner performance in a machine, low cohesion numbers are desired. As illustrated in FIG. 5, an appropriate choice of ultra large spacer in combination with other 40 nm external additives (toner 3) gives cohesion aging behavior very similar to the conventional toner control (toner 1).

In conclusion, we have shown that adding an ultra-large spacer to the additive set of a conventional toner has no detrimental effect on tribo level, tribo stability with aging, charge-through behavior and cohesion when the proper ultra-large spacer additive amount and treatment is chosen and this additive is used in combination with other 40 nm fumed silicas and titanias. The ultra-large spacer has been shown to improve transfer efficiency maintainability for chemical toner by protecting the smaller sized additives from impaction into the toner surface as a result of developer housing abuse. The smaller sized additives as well as the ultra-large spacer remain above the surface of the toner during aging. The ultra-large spacer behaves similarly on conventional toner.

What is claimed is:

1. A toner composition comprising toner particles having at least one spacer comprised of latex particles attached to the toner particles, wherein the latex particles as formed have a substantially monodisperse particle size distribution and are dried prior to attachment to the toner particles, wherein the attached latex particles have an average particle size of from about 60 nm to about 500 nm, and wherein the latex particles are selected from the group consisting of rubber and polyester latexes.

2. The toner composition according to claim 1, wherein the spacer is present in an amount of about 0.1 to about 20 percent by weight of the toner composition.

3. The toner composition according to claim 1, wherein the toner particles are comprised of resin binder and a colorant.

4. The toner composition according to claim 1, wherein the toner particles further include one or more external additives selected from the group consisting of silica, titania and zinc stearate, wherein the external additives have an average particle size of from about 5 nm to about 40 nm.

5. The toner composition according to claim 4, wherein each of the external additives present is present in an amount of from about 0.1 to about 5 percent by weight of the toner composition.

6. The toner composition according to claim 1, wherein the latex particles have an average particle size of from about 220 nm to about 500 nm.

7. A toner composition comprising toner particles having at least one spacer comprised of latex particles attached to the toner particles, wherein the attached latex particles have an average particle size of from about 220 nm to about 500 nm, and wherein the latex particles are selected from the group consisting of rubber, and polyester latexes.

8. A process for decreasing toner cohesion comprising forming at least one spacer particle comprised of latex particles that are substantially monodisperse in particle size distribution, and subsequently drying the substantially monodisperse latex particles, forming toner particles including a grinding step, and following completion of the grinding step, attaching to the toner particles the dried latex particles, wherein the latex particles as attached have an average particle size of from about 60 nm to about 500 nm, and wherein the latex particles are selected from the group consisting of rubber and polyester latexes.

9. The process according to claim 8, wherein the latex particles are attached to the toner particles by dry blending the at least one spacer particle and the toner particles together.

10. The process according to claim 8, wherein the forming of the toner particles further comprises classifying the toner particles following grinding.

11. The process according to claim 8, wherein the latex particles are attached in an amount of about 0.1 to about 20 percent by weight of the toner composition.

12. The process according to claim 8, wherein the toner particles are comprised of resin binder and a colorant.

13. The process according to claim 8, wherein the process further comprises attaching to the toner particles one or more external additives selected from the group consisting of silica, titania and zinc stearate, wherein the external additives have an average particle size of from about 5 nm to about 40 nm.

14. The process according to claim 13, wherein the attaching of the one or more external additives occurs following completion of the grinding step.

15. The process according to claim 13, wherein the attaching of the one or more external additives occurs during the attaching of the latex particles.

* * * * *